United States Patent [19]

Campau

[11] Patent Number: 4,927,568

[45] Date of Patent: May 22, 1990

[54] APPARATUS FOR AERATING WATER IN A CONTAINER

[75] Inventor: Daniel N. Campau, Grand Rapids, Mich.

[73] Assignee: Flow-Rite Controls, Ltd., Grand Rapids, Mich.

[21] Appl. No.: 403,563

[22] Filed: Aug. 31, 1989

Related U.S. Application Data

[63] Continuation-in-part of Ser. No. 196,025, May 19, 1988, Pat. No. 4,865,776.

[51] Int. Cl.[5] ..... B01F 3/04

[52] U.S. Cl. ..... 261/36.1; 261/DIG. 75; 119/3; 119/5

[58] Field of Search ..... 261/36.1, DIG. 75; 119/2, 3, 5

[56] References Cited

U.S. PATENT DOCUMENTS

| | | | |
|---|---|---|---|
| 471,501 | 3/1892 | Houston et al. | 119/3 |
| 721,036 | 2/1903 | Gwynne et al. | 261/DIG. 75 |
| 2,241,337 | 5/1941 | Work | 261/DIG. 75 |
| 2,305,796 | 12/1942 | Seidel | 119/5 |
| 2,772,867 | 12/1956 | Cleckner | 119/5 |
| 3,146,195 | 8/1964 | Berardi | 119/5 |
| 3,348,826 | 10/1967 | Karley | 119/5 |
| 3,638,616 | 2/1972 | Carmouche | 119/5 |
| 3,640,516 | 2/1972 | Willinger | 119/5 |
| 3,727,579 | 4/1973 | Lee | 119/2 |
| 3,806,964 | 4/1974 | Vanegas et al. | 261/DIG. 75 |
| 4,357,902 | 11/1982 | Sheldon et al. | 119/3 |
| 4,602,391 | 7/1986 | Shepherd | 261/DIG. 75 |
| 4,639,340 | 1/1987 | Garrett | 261/DIG. 75 |
| 4,735,750 | 4/1988 | Damann | 261/DIG. 75 |
| 4,766,001 | 8/1988 | Mizandjian et al. | 261/DIG. 75 |

*Primary Examiner*—Tim Miles

*Attorney, Agent, or Firm*—Niro, Scavone, Haller & Niro, Ltd.

[57] ABSTRACT

A novel and unique apparatus is disclosed for use in aerating water held in a container, such as a livewell in a fishing boat. The aeration apparatus receives fresh water through a conventional water distribution system, aspirates ambient air into the water, and discharges the mixture of fresh water and aspirated air within the livewell at a location substantially below its water level. Air is aspirated into the fresh water by means of a housing mounted above the water level in the livewell. The housing includes a main passageway through which the fresh water passes and an aspirating port in the housing wall which puts the main passageway in communication with ambient atmosphere above the livewell. A discharge tube receives the mixture of fresh water and aspirated air from the housing and directs it to a plurality of discharge ports positioned substantially below the livewell water level. The discharge ports are positioned and sized to disperse the mixture of fresh water and aspirated air throughout the livewell and to break up the aspirated air into small bubbles to facilitate and enhance oxygenation. A pump incorporated in the water distribution system can either draw fresh water for delivery to the aeration apparatus or, alternatively, it may recirculate livewell water to the aeration apparatus.

4 Claims, 2 Drawing Sheets

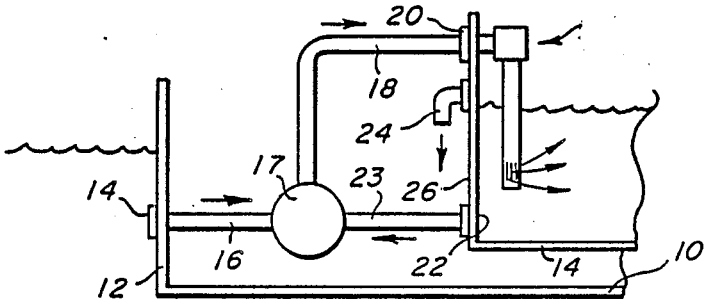
FIG. 1
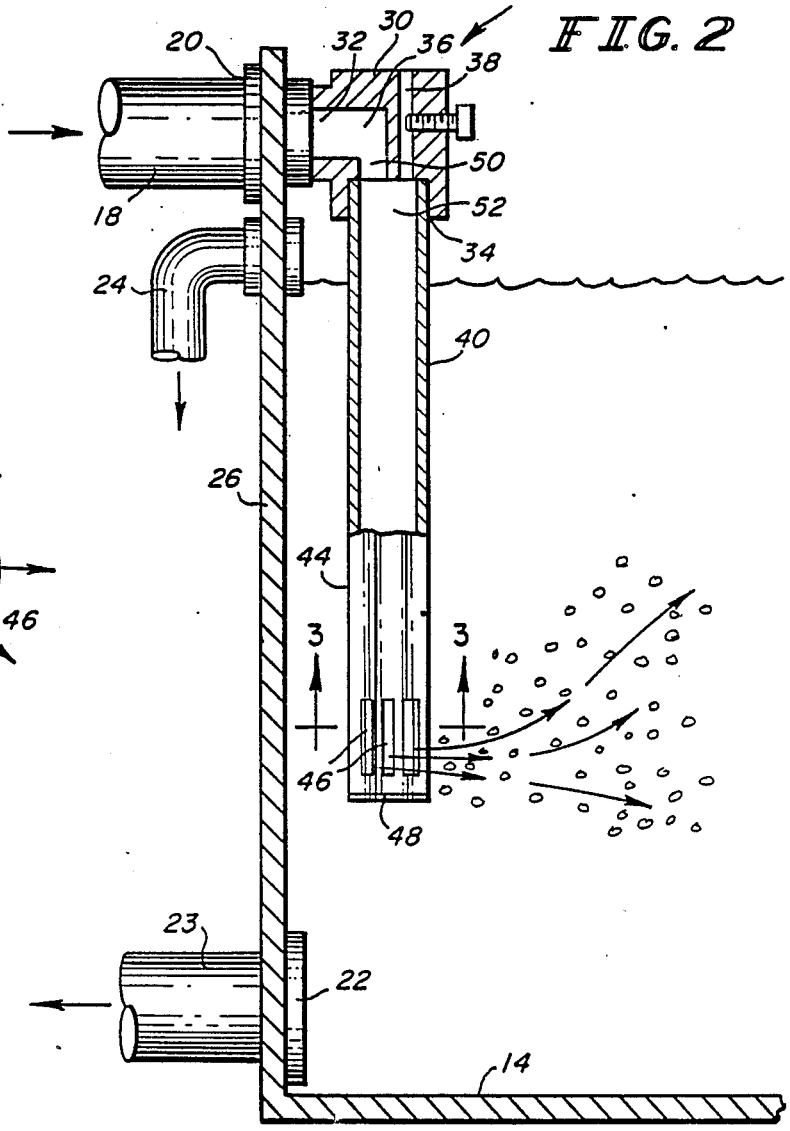
FIG. 2
FIG. 3
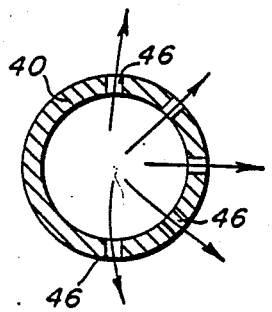

18
30
39
39'
25
54
53
55
26
42
56
41
14

APPARATUS FOR AERATING WATER IN A CONTAINER

This application is a continuation-in-part of application Ser. No. 07/196,025, filed May 19, 1988, now U.S. Pat. No. 4,865,776.

BACKGROUND OF THE INVENTION

The present invention is directed to an apparatus for use in aerating water in a container, and more particularly, to an improved aeration system for use with livewells commonly fitted in fishing boats.

In recent years, there has been an ever-increasing interest in sport fishing. The most common competition format used in sport fishing is one called "catch and relaase" where the contestants are permitted to fish for a certain period of time and the fish caught during the competition are compared among the various contestants to determine a winner and then released. In almost all competition today, the fish must be alive and undamaged at the end of the competition in order to qualify. Therefore, there is a need for a safe and effective aeration system to maintain proper oxygen levels within the livewell of the fishing boat in which the caught fish are held during the competition.

A variety of such aeration devices have been used in the past, but none has proven entirely satisfactory. Most aeration systems have used an aerator pump to either draw fresh water from the outside of the boat or to recirculate livewell water through a spray nozzle above the livewell water level. The high velocity water passing through the spray nozzle creates turbulence on the surface of a livewell which entrains air for oxygenation. In the simplest aeration systems a transom mounted pump draws fresh water and sprays it into the livewell. Most of the oxygenated water is lost out of the overflow because only the surface layer of water within the livewell is oxygenated. Some improvement has been achieved in other prior art devices by adding a second pump to just recirculate the livewell water through the spray nozzle. This has helped to move and cool the lower water levels within the livewell, but oxygenation is still mostly limited to the surface water. Also, spray nozzles generally create large bubbles which rise quickly and are less efficient than small bubbles in the oxygenation process.

Other prior art devices are also known which include the use of a relatively expensive air pump system to provide substantial amounts of oxygen to the livewell. These air pumps, however, are expensive, noisy and subject to failure under heavy use and boat vibration. These air bubble systems also require air tubing and either a porous stone or perforated ring on the bottom of the livewell to distribute the air in small bubbles.

SUMMARY OF THE INVENTION

The present invention is directed to a new and significantly improved aeration system which overcomes the problems associated with prior art aeration systems. Thus, significant improvement in aeration efficiency is achieved and reliability of the system enhanced, while reducing costs and noise levels. In addition, the apparatus of the present invention is easily assembled into existing fishing boats, and it occupies a minimum amount of space within the livewell, thereby reducing the tendency of fish to be injured or damaged while being held within the livewell.

The apparatus for aerating water in a container made in accordance with the present invention includes a housing to receive a supply of incoming water and a discharge tube connected at one end to the housing and having a free end which extends substantially below the water level in the livewell receptacle. The housing has a main flow passageway through which the incoming water passes and an air port which permits air to be aspirated into the water as it passes through the housing. Finally, the housing includes means for aspirating air through the air port and into the incoming water. The discharge tube receives the incoming water and aspirated air and directs it to a discharge port at the free end of the tube which is positioned substantially below the level of water in the container. Moreover, the free end of the discharge tube includes means for dispersing the water and aspirated air throughout the container. This is accomplished by positioning the discharge ports so as to direct the water and aspirated air in small bubbles into different areas of the container.

In another preferred embodiment of the invention, the aerator apparatus and a curved inlet conduit are mounted externally to the livewell receptacle. The external mounting is simply achieved by clamping the curved inlet conduit to a boss or other fastening device on the side of the livewell. The curved inlet conduit is then attached to a tangential discharge outlet. The tangential discharge outlet passes through the livewell sidewall, and a discharge port at the end of the outlet is positioned to direct water and aspirated air horizontally into the livewell receptacle.

BRIEF DESCRIPTIONS OF THE DRAWINGS

The novel features of the invention are set forth in the appended claims. However, the preferred embodiments of the invention, together with further objects and attendants advantages thereof, will be best understood by reference to the following description taken in connection with the accompanying drawings in which:

FIG. 1 is a diagrammatic view illustrating a livewell and water distribution system for the livewell which includes an aeration apparatus of the present invention;

FIG. 2 is an enlarged side view showing the livewell depicted in FIG. 1 together with the aeration apparatus, in partial cross-section and showing details of the aeration apparatus construction; and FIG. 3 is a cross-sectional view taken along line 3—3 of FIG. 2 and illustrating details of one preferred dispersing means used in the aeration apparatus discharge tube.

DETAILED DESCRIPTION OF THE PREFERRED EMBODIMENTS

Figure 4:
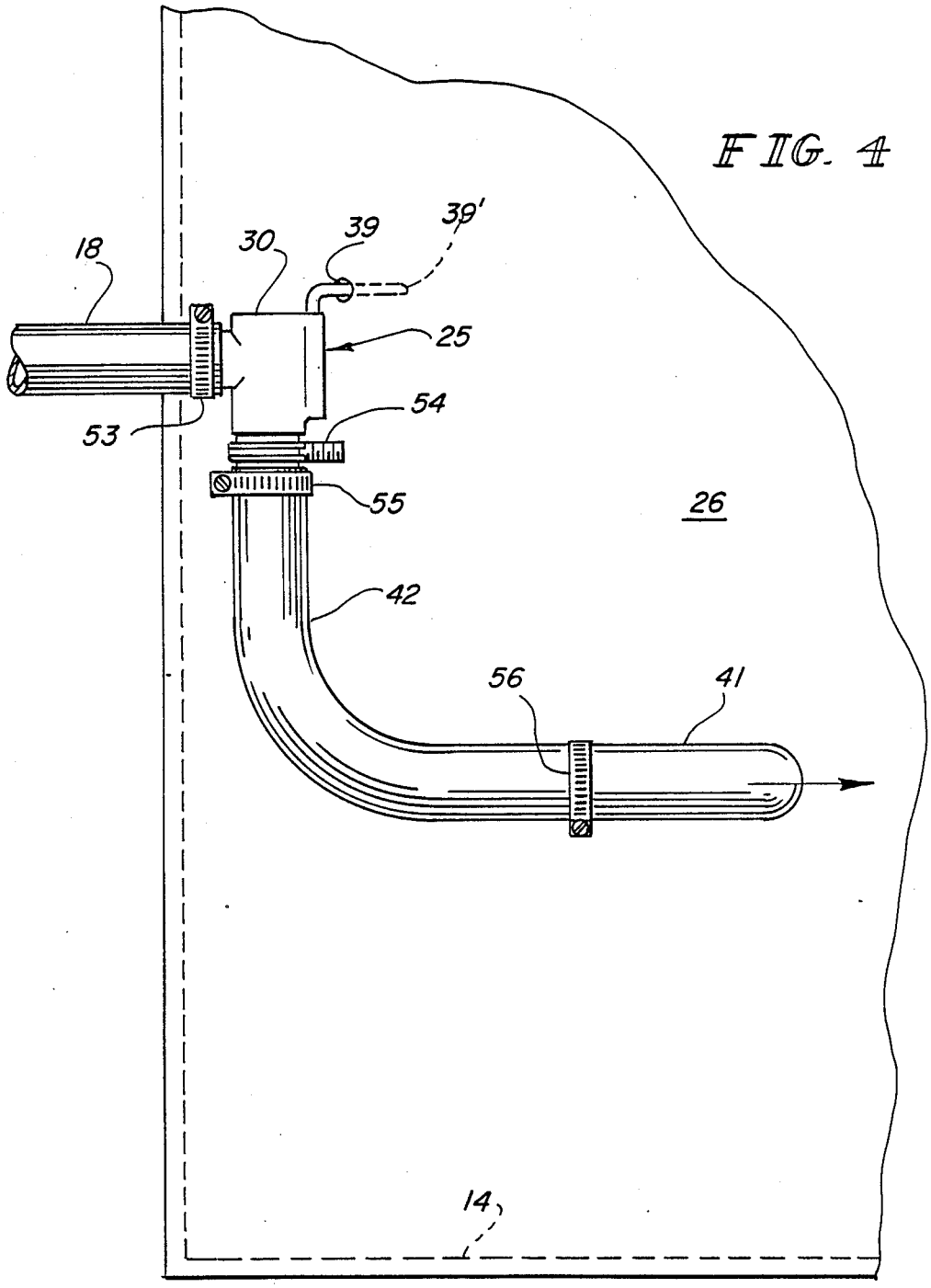
FIG. 4 is a side view of the aeration apparatus of the present invention illustrating another preferred embodiment utilizing an external mounting arrangement.

While the invention is susceptible of various modifications and alternative constructions, two preferred embodiments have been shown in the drawings and will be described below in detail. It is understood, however, that there is no invention to limit the invention to the specific constructional form disclosed, but on the contrary, the intention is to cover all modifications, alternative constructions, and equivalents falling within the spirit and scope of the invention.

With reference to FIG. 1, a portion of a boat hull 10 is illustrated with a rear transom 12 and in which a livewell receptacle 14 is mounted in a manner well known to those of ordinary skill in the art. A water distribution system is also illustrated including port 13, conduit 16, pump 17 and conduit 18 which feeds water to the inlet 20 of the livewell. The livewell also includes a drain port 22 with return and an overflow port 24 all of which is conventional and well known to those of ordinary skill in the art. In accordance with the present invention, the so illustrated livewell and water distribution system is equipped with an aeration apparatus generally designated as 25 which may be directly coupled to the inlet 20 and which is mounted adjacent one sidewall 26 of the receptacle 14.

Referring now to FIG. 2, the aeration apparatus 25 is illustrated in greater detail, and is shown to include a housing 30 having an inlet 32 and an outlet 34. The housing 30 also includes a main flow passageway 36 extending between the inlet and outlet and an air port 38 which permits air to pass from the ambient atmosphere above the level of water within the livewell to the interior of the housing. The aspiration apparatus 25 also includes a discharge tube 40 having one end connected to the outlet 34 of the housing and a free end 44 which is positioned a substantial distance below the water level in the livewell. Means are also provided adjacent the free end 44 of the discharge tube for dispersing incoming water and aspirated air into the livewell. While the dispersing means may take on any one of a number of configurations well known to those of ordinary skill in the art, a preferred embodiment includes a plurality of discharge ports or slots 46 which are positioned around the sidewall of the discharge tube 40 so as to direct water and aspirated air in a number of different directions, thereby facilitating the dispersion of air bubbles throughout the livewell. It should be noted that in the vast majority of existing livewell systems used in fishing boats the inlet 20 and drain port 22 are both located on a common sidewall of the livewell. In these circumstances, because the discharge tube has its free end 44 located at a substantial distance below the water level and in relatively close proximity to the drain port 22, it is preferred that the bottom of the discharge tube have a closure 48 which prevents air bubbles being directed straight down into the vicinity of discharge port or drain port 22. This, in turn, prevents air cavitation within pump 17 when livewell water is being recirculated via conduits 23 and 18.

The aeration apparatus 25 further includes means for aspirating air into the incoming water as it passes through flow passageway 36. In the illustrated embodiment the aspirating means compromises a reduced cross section 50 in the flow passageway followed by a downstream enlarged section 52. Because of the velocity of water flow through the housing the change in area of the flow passageway causes a separation of the water from the internal sidewall of the housing, this separation creates a region of low pressure relative to atmospheric pressure at the point immediately adjacent air port 38. Therefore, as water passes through housing 30 air is aspirated from the atmosphere above the level of water in the livewell and into discharge tube 40 where it mixes with the incoming water and is ultimately discharged into the livewell through discharge ports 46.

The discharge ports may take on a variety of constructions such as the illustrated slots 46, or holes or screens. Whatever construction is chosen the discharge ports should break up the aspirated air into small bubbles while not creating significant back pressure at the main flow passageway 36. This means the discharge ports should be sized so that the velocity of incoming water through passageway 36 will be sufficiant to properly aspirate air into the water flow throughout the range of conventional pumps used in such livewell systems, i.e. pumps with capacities from 350 to 800 gallons per hour.

By virtue of the arrangement of components in accordance with the practice of the present invention, preferred advantages are achieved. For example, air is aspirated into the incoming water flow at a point above the livewell water level while the mixture of aspirated air and water is discharged into the livewell at a point substantially below the water level. Moreover, the aspiration apparatus of the present invention utilizes a discharge tube which may be located adjacent to the livewell side wall with a minimum protrusion into the livewell, while nevertheless discharging the mixture of incoming water and entrained air bubbles through a wide area, as much as 180 degrees.

By virtue of this construction and because the air is introduced into the aspiration apparatus above the water level in the livewell, no siphon action can develop. Thus, water cannot be siphoned into or out of the livewell through the aspiration device because of changes in external lake water level.

In accordance with one preferred embodiment of the invention, an adjustment screw 60 is mounted in housing 30 so that the effective cross sectional area of port 38 may be varied to adjust the amount of air aeration for a given velocity of wate flowing through the aspiration apparatus.

In operation, the pump 17 draws fresh water through inlet 13 and passes the incoming water through conduit 18 and into the aspiration apparatus where it is mixed with aspirated air and ultimately discharged into the livewell. In addition, livewell water may be drawn by the pump 17 through drain port 22 and recirculated to the livewell, thereby oxygenating the livewell water without drawing fresh water from outside of the boat.

It will be appreciated by those of ordinary skill in the art that the precise location of the free end 44 of discharge tube 40 will depend upon circumstances associated with the particular livewell system. In theory, the mixture of incoming water and aspirated air should be discharged into the livewell at a level as close to the bottom of the livewell as is practical. However, because the drain port 22 is typically positioned adjacent the bottom of the livewell it is desireable to position the free end 44 of the discharge tube at a somewhat mid-level in the livewell. In any event, the discharge port 46 at the free end of discharge tube 40 should be positioned at least several inches below the water level in the livewell, preferably about six to ten inches below water level.

Another preferred embodiment of the invention, illustrated in FIG. 4, employs an external mounting arrangement for the aeration apparatus 25 to one sidewall 26 of the receptacle 14. In this embodiment, the aeration apparatus 25 is clamped or otherwise attached to a boss or other fastening device 54 on the side of the livewell. A conduit 18 is connected to the aeration apparatus by a hose clamp 53 or any other fitting, adhesive or coupling device. A curved inlet conduit 42 is at one end connected to the aeration apparatus 25 by a hose clamp 55 or any other fitting, adhesive or coupling device. The other end of curved inlet conduit 42 is connected to a tangential discharge outlet 41 by a hose clamp 56 or any other fitting, adhesive or coupling device. It is desireable to position tangential discharge outlet 41 at a somewhat mid-level in the livewell. In any event, tangential discharge tube 41 should be positioned at least several inches below the water level in the livewell, preferably about six to ten inches below water level. Tangential discharge outlet 41 passes through one sidewall 26 at one end. A tangential fluid flow of water and aspirated air passes through the tangential discharge outlet 41 at the free end and is discharged into the livewell. An air intake conduit 39' is mounted on the housing 30 of the aeration apparatus 25; this air intake conduit 39 permits air to pass from the ambient atmosphere above the level of water within the livewell to the interior of the housing. The free end of the air intake conduit 39' is inserted through a hole in the livewell above the overflow level.

While the aspiration apparatus of the present invention may be constructed from a variety of different materials well known to those of ordinary skill in the art, it is preferable that the apparatus be constructed from plastic which is not only inexpensive and easily constructed through conventional injection molding techniques, but is also resistant to corrosion or damage due to vibration or impact.

One advantage associated with the apparatus of the present invention is that it may be readily substituted for existing aeration devices now used in most fishing boats. The existing aeration devices which consist of a perforated tubing can be removed from the inlet 20 of the livewell and the aspiration device of the present invention connected in its place.

What is claimed is:

1. An apparatus for aerating water in a livewell mounted within a fishing boat, said apparatus comprising:

a livewell receptacle having sidewalls and a bottom for holding water, said receptacle including a drair port adjacent its bottom, an overflow port in one of said sidewalls, and an inlet;

conduit means and pump means in communication with an external water supply for providing water to said inlet;

an aerator apparatus mounted in said conduit means externally of said receptacle, said aerator apparatus including a main flow passageway in communication with an air intake conduit having a free end located internally of said receptacle and in communication with the ambient atmosphere at a level above said overflow port;

means within said aerator apparatus for aspirating air through said air intake conduit and into the water flowing through said main flow passageway;

an inlet conduit connected to said aerator apparatus for receiving said water and aspirated air, said inlet conduit being mounted externally of said receptacle; and a tangential discharge tube connected to said inlet conduit, said tangential discharge tube mounted in one of the sidewalls of said receptacle and adapted to direct said water and aspirated air into said receptacle; said tangential discharge tube having a free end positioned below the level of the overflow port.

2. The livewell aerating apparatus of claim 1 wherein said overflow port and said drain port are located on a common receptacle sidewall.

3. The livewell aerating apparatus of claim 1 wherein said pump means has a capacity of from 350 to 800 gallon per hour and said discharge ports are sized to break up said aspirated air into small bubbles while not creating significant back pressure within said main flow passageway through the range of said pump means capacity.

4. The livewell aerating apparatus of claim 1 wherein said free end of said tangential discharge tube is positioned at a generally mid-level location within said receptacle.

* * * * *